US007207630B1

(12) United States Patent
Reynolds

(10) Patent No.: US 7,207,630 B1
(45) Date of Patent: Apr. 24, 2007

(54) REMOVABLE ADJUSTABLE HEADREST FOR WHEELCHAIRS HAVING A NECK ROLL

(76) Inventor: Robert Reynolds, 1245 Linworth Ave., Apt. 3B, Baltimore, MD (US) 21239

( * ) Notice: Subject to any disclaimer, the term of this patent is extended or adjusted under 35 U.S.C. 154(b) by 0 days.

(21) Appl. No.: 11/387,827

(22) Filed: Mar. 23, 2006

Related U.S. Application Data

(63) Continuation-in-part of application No. 11/089,904, filed on Mar. 25, 2005, now abandoned.

(60) Provisional application No. 60/556,623, filed on Mar. 26, 2004.

(51) Int. Cl.
*A47C 7/36* (2006.01)

(52) U.S. Cl. ..... 297/397; 297/391; 297/400; 248/118; 280/250.1; 280/304.1

(58) Field of Classification Search ..... 297/397–402, 297/DIG. 4, 391, 392; 248/118; 280/250.1, 280/304.1
See application file for complete search history.

(56) References Cited

U.S. PATENT DOCUMENTS 3,497,259 A * 2/1970 Sherfey ..... 297/391
4,114,948 A * 9/1978 Perkey ..... 297/397
5,074,574 A * 12/1991 Carwin ..... 280/304.1
5,308,028 A * 5/1994 Kornberg ..... 248/118
5,967,613 A * 10/1999 McKeever ..... 297/397
6,030,034 A * 2/2000 Plohetski ..... 297/188.06
6,158,812 A * 12/2000 Bonke ..... 297/391
6,431,651 B1 * 8/2002 Lee ..... 297/397
7,032,974 B1 * 4/2006 Berger ..... 297/398
7,093,903 B2 * 8/2006 O'Connor et al. ..... 297/397

* cited by examiner

*Primary Examiner*—Laurie K. Cranmer

(57) ABSTRACT

A removable adjustable head rest for wheelchairs for providing users of wheelchairs with much needed back and neck support. The headrest includes a hollow cylindrical main portion, a pair of handle sleeves, and a head rest portion. The hollow cylindrical main portion has a generally inverted T-shaped configuration, a horizontal segment, and a vertical segment. A pair of handle sleeves are attached to the horizontal segment of the hollow cylindrical main portion. A head rest, having two integrally coupled adjustable side portions, is removable coupled to the vertical segment of the hollow cylindrical main portion. A neck roll removable coupled to the head rest.

3 Claims, 3 Drawing Sheets

REMOVABLE ADJUSTABLE HEADREST FOR WHEELCHAIRS HAVING A NECK ROLL

CROSS-REFERENCE TO RELATED APPLICATION

This application is a continuation-in-part of patent application Ser. No. 11/089,904 filed on Mar. 25, 2005 now abandoned which is a continuation of provisional application No. 60/556,623 filed on Mar. 26, 2004.

BACKGROUND OF THE INVENTION

The invention relates to a removable adjustable head rest for wheelchairs for providing users of wheelchairs with much needed neck support.

Individuals who use manual wheelchairs generally have lower extremity weakness, paralysis, or amputation, making walking unsafe or difficult at best. They may include individuals with spinal cord injuries, hemiplegia and other types of paralysis, multiple sclerosis, cerebral palsy, spina bifida, arthritis, and lower limb amputations. Manual chairs have a number of advantage over power chairs, and most people prefer to use a manual chairs if at all possible. Manual wheelchairs are more discreet than power chairs since they are less bulky, and with no motor noise, they are much quieter. While it may take more work to operate a manual chair, these lightweight mobiles are getting lighter all the time, and now require less strength and energy to push than their predecessors.

While the low cost and lack of maintenance required for manual wheelchairs encompass a large part of their appeal, use of these chairs does present a significant drawback. Particularly, most manual wheelchairs lack the back and neck support that is standard with the pricey power models. Largely equipped with only flat cloth or vinyl backs designed to fold when manual chairs are stored, these models provide no lumbar support, lateral stability, or accommodation of people with more advance orthopedic needs. In addition, the absence of sufficient neck support can be uncomfortable, not to mention detrimental, for those whose disease is progressive to the point that they experience a loss of control of the neck and head. Unfortunately, the convenience of manual wheelchairs can be negated by their primitive construction. What is needed is a portable device that can attach to a manual wheelchair and provide neck and back support to the user.

The present invention attempts to solve the abovementioned problem by providing a removable adjustable head rest for wheelchairs for providing users of wheelchairs with much needed neck support.

U.S. Pat. No. 5,967,613 to McKeever discloses a fully adjustable head support assembly held by a vertical bar attached at its lower end to a cross bar for fitting a typical wheelchair. U.S. Pat. No. 6,419,321 to Sack discloses and adjustable head support rest that is connected to a wheel chair device. U.S. Pat. No. 4,732,423 to Condon discloses an adjustable invalids chair. U.S. Pat. No. 3,497,259 to Sherfey discloses a head or back support that are adjustable both horizontally, vertically, and angularly are attached to the wheelchair handles by a horizontal bar. U.S. Pat. No. 5,074,574 to Carwin discloses an adjustable headrest system secured to the handles of the wheelchair and also to the lower portion of the wheelchair frame.

While these units may be suitable for the particular purpose employed, or for general use, they would not be as suitable for the purposes of the present invention as disclosed hereafter.

SUMMARY OF THE INVENTION

It is an object of the invention to produce a removable adjustable head rest for wheelchairs for providing users of wheelchairs with much needed neck support.

It is another object of the invention to produce a removable head rest for wheelchairs having a selectively adjustable head rest for cradling and supporting the head of a user.

It is another object of the invention to produce a removable head rest for wheelchairs that includes a removable neck roll for comfortably supporting the neck of the user.

The present invention is comprised of a hollow cylindrical main portion having a generally inverted T-shaped configuration. The main portion has a horizontal segment and a vertical segment. The horizontal segment has opposed open ends. The horizontal segment has a plurality of horizontally aligned apertures therethrough extending inwardly from the opposed open ends thereof. The horizontal segment has a central opening therethrough disposed on a vertical axis. The vertical segment has an open upper end. The open upper end is aligned with the central opening of the horizontal segment. The vertical segment has a plurality of vertically aligned apertures therethrough extending downwardly from the open upper end. A pair of handle sleeves are adjustably received from the opposed open ends of the horizontal segment of the hollow cylindrical main portion. Each of the handle sleeves has an inner end and an outer end. The inner ends are received within the open ends of the horizontal segment. The sleeves each have a spring-biased male detent element extending outwardly therefrom. The male detent element selectively aligns with one of the plurality of horizontally aligned apertures to fix the sleeve with respect to the horizontal segment. The outer ends of each of the sleeves have a tubular collar secured thereto. The tubular collars are adapted to receive opposed handles of a wheelchair therein. A headrest portion including two integrally coupled side portions is removably coupled with the hollow cylindrical main portion. The headrest portion includes a vertical shaft. The vertical shaft has an upper end and a lower end. The lower end is received within the open upper end of the vertical segment of the main portion and extends through the central opening in the horizontal segment of the main portion. The vertical shaft has a male detent element extending outwardly therefrom. The male detent element selectively aligns with one of the plurality of vertically aligned apertures to fix the vertical shaft with respect to the vertical segment. The head rest portion includes an arcuate padded portion secured to the upper end of the vertical shaft.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
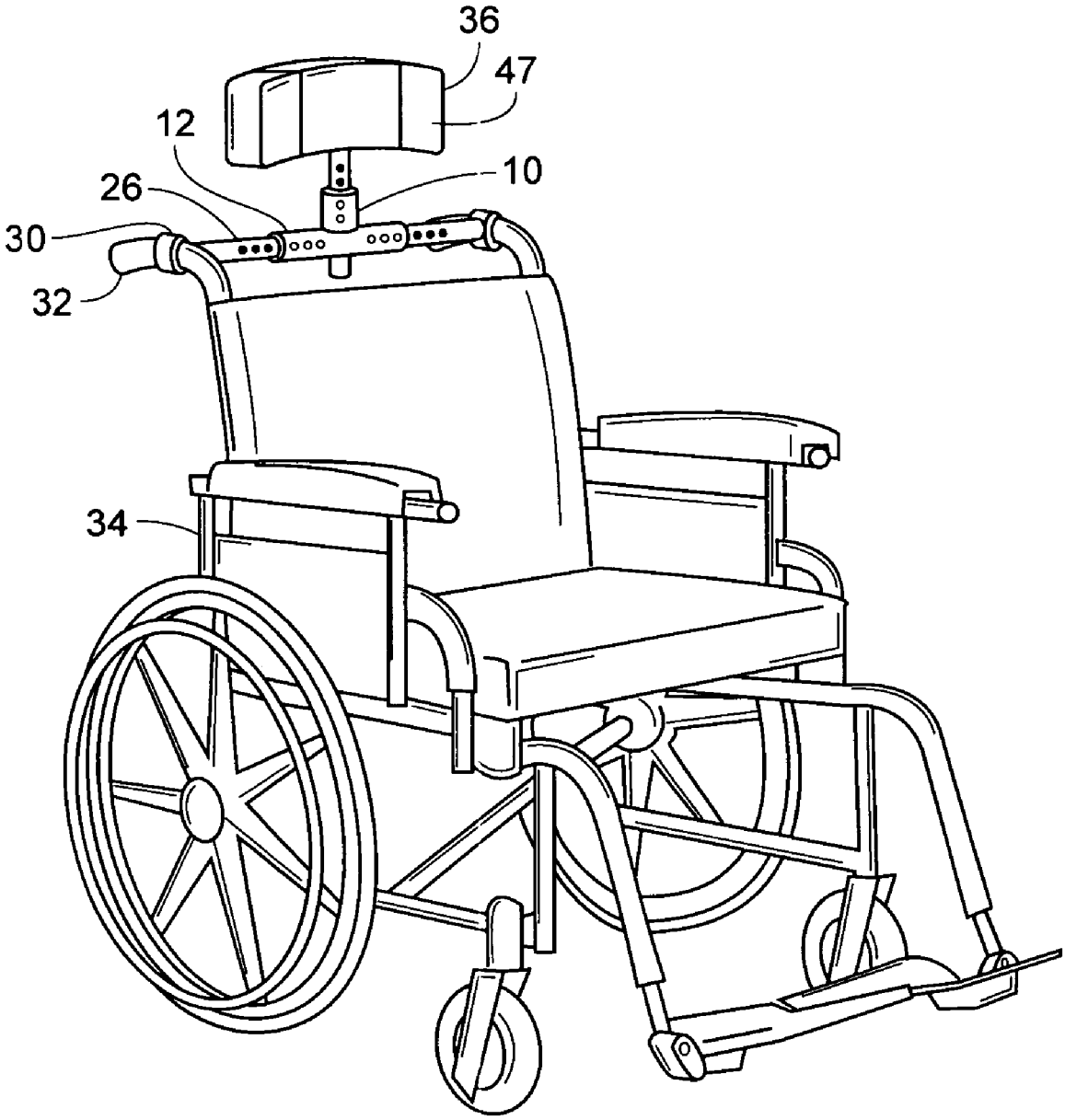
FIG. 1 is a perspective view of the removable adjustable head rest of the present invention illustrated in use.

FIG. 1 illustrated a removable adjustable head rest for wheelchairs for providing users of wheelchairs with much needed back and neck support. The present invention is essentially comprised of a hollow cylindrical main portion, a pair of handle sleeves, and a headrest portion.

Figure 4:
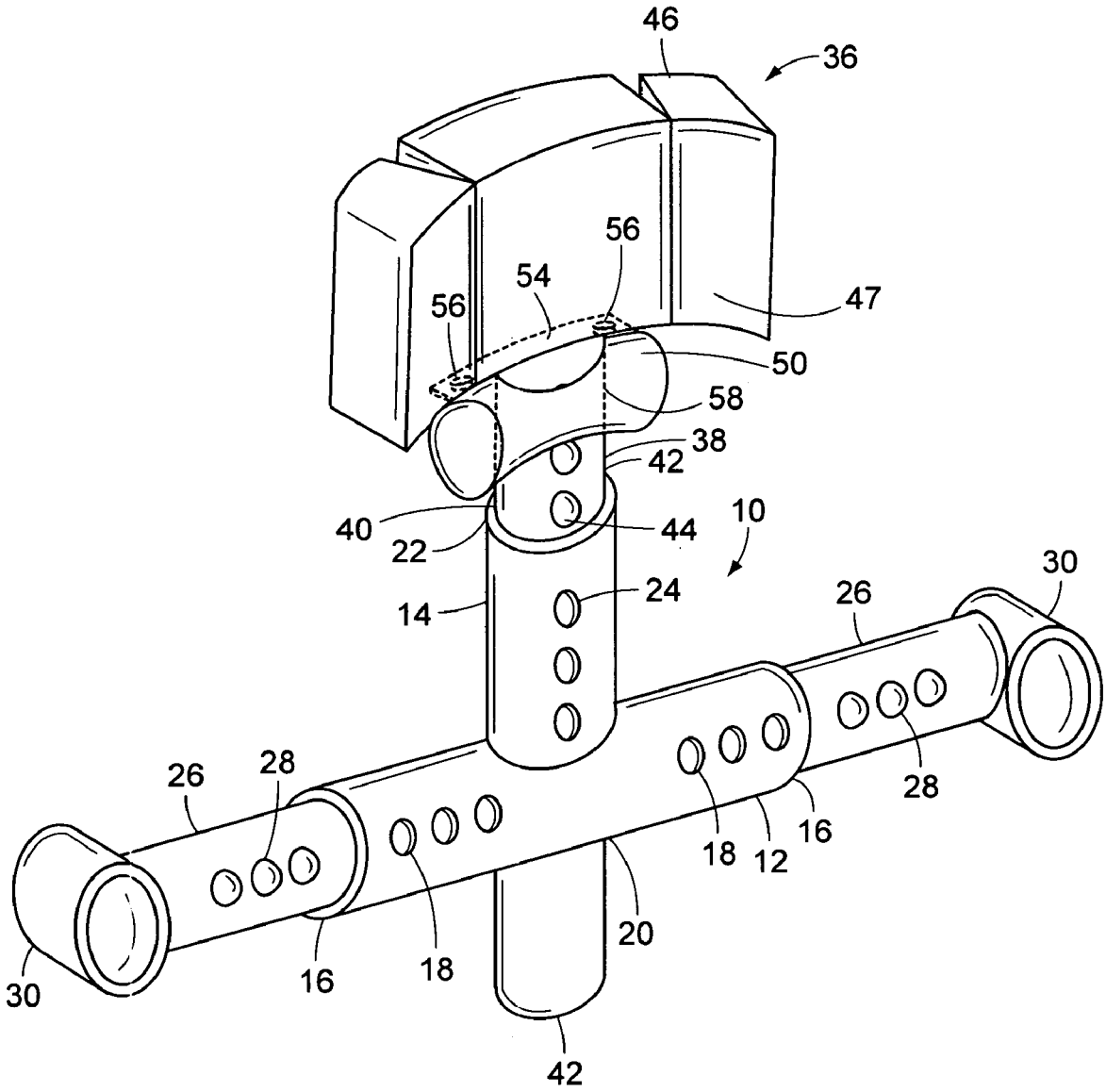
FIG. 4 is a perspective view of the removable head rest of the present invention.

FIG. 4 illustrates the hollow cylindrical main portion 10, which has a generally inverted T-shaped configuration. The main portion 10 has a horizontal segment 12 and a vertical segment 14. The horizontal segment 12 has opposed open ends 16. The horizontal segment 12 has a plurality of horizontally aligned apertures 18 therethrough extending inwardly from the opposed open ends 16 thereof. The horizontal segment 12 has a central opening 20 therethrough disposed on a vertical axis. The vertical segment 14 has an open upper end 22. The open upper end 22 is aligned with the central opening 20 of the horizontal segment 12. The vertical segment 14 has a plurality of vertically aligned apertures 24 therethrough extending downwardly from the open upper end 22.

Figure 3:
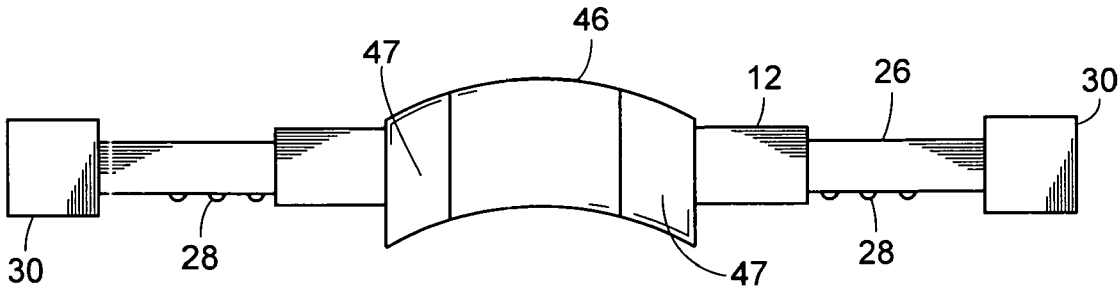
FIG. 3 is a top plan view of the removable head rest of the present invention.

The pair of handle sleeves 26 are adjustably received within the opposed open ends 16 of the horizontal segment 12 of the hollow cylindrical main portion 10. Each of the handle sleeves 26 has an inner end and an outer end. The inner ends are received within the open ends 16 of the horizontal segment 12. The sleeves 26 each have a spring-biased male detent element 28 extending outwardly therefrom as shown in FIG. 3. The male detent element 28 selectively aligns with one of the plurality of horizontally aligned apertures 18 to fix the sleeve 26 with respect to the horizontal segment 12. The outer ends of each of the sleeves 26 have a tubular collar 30 secured thereto. The tubular collars 30 are adapted to receive opposed handles 32 of a wheelchair 34 therein as shown in FIG. 1. The handles 32 of the wheelchair 34 are substantially parallel to each other, and are spaced apart at a handle width. A distance between the tubular collars 30 may be adjusted by adjusting the position of the handle sleeves within the horizontal segment, to accommodate the handle width of the wheelchair.

Figure 2:
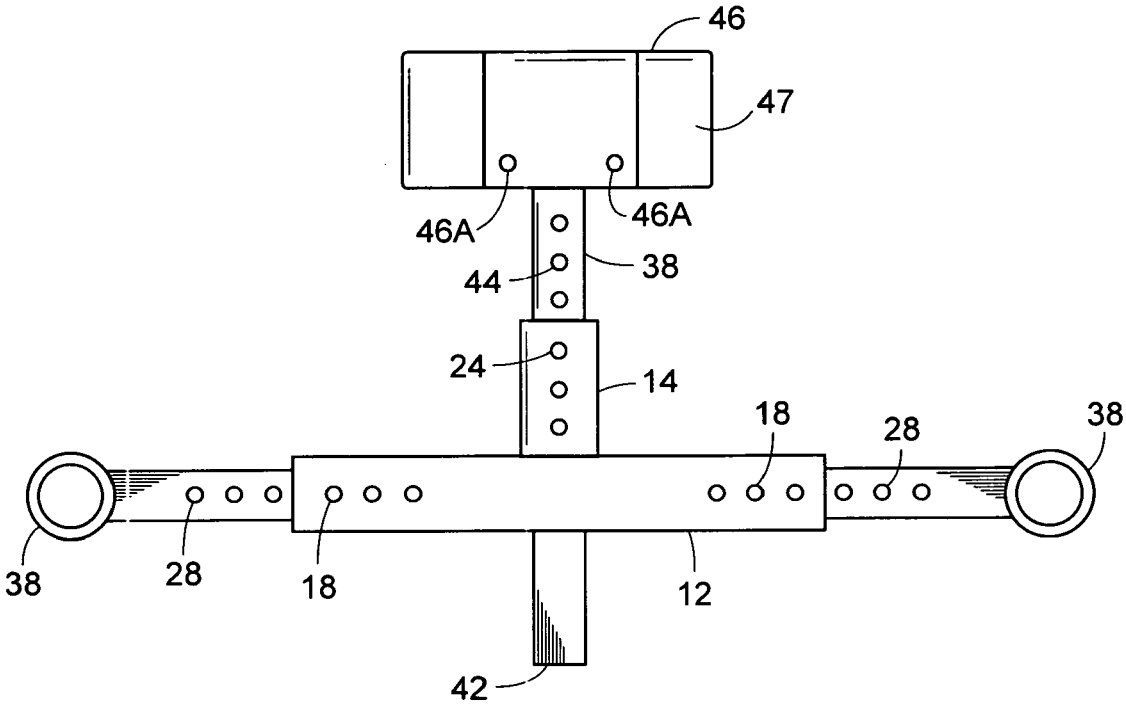
FIG. 2 is an elevated front view of the removable head rest of the present invention.

The headrest portion 36 is removably coupled with the hollow cylindrical main portion 10. The headrest portion 36 includes a vertical shaft 38. The vertical shaft 38 has an upper end 40 and a lower end 42. The lower end 42 is received within the open upper end 22 of the vertical segment 14 of the main portion 10 and extends through the central opening 20 in the horizontal segment 12 of the main portion 10. The vertical shaft 38 has a male detent element 44 extending outwardly therefrom as shown in FIG. 2. The male detent element 44 selectively aligns with one of the plurality of vertically aligned apertures 24 to fix the vertical shaft 38 with respect to the vertical segment 14. The headrest portion 36 includes an arcuate padded portion 46, having two snaps 46A and secured to the upper end 40 of the vertical shaft 38. Note that the headrest portion 36 may be configured in various ways, in order to ensure the comfort of the person seated in the wheelchair. For example, the headrest portion 36 may be made to recline at a forty-five degree angle to allow the person to relax his/her neck. The headrest portion 36 includes two integrally coupled adjustable side portions 47, which allow the headrest to be bent inwardly forming a U shape for cradling the head of the user. This would create even more head and neck stability for the person seated in the wheelchair. In addition, the user can bend one or both of the side portions inwardly as much or as little as desired in order to selectively stabilize and support the head. Additional configurations may be provided to most comfortably accommodate paraplegic, quadriplegic, and stroke victims.

A neck roll 50 having a substantially elongated roll 52 having an attachment strip 54 and two snaps 56 is selectively coupled to the padded portion 46. The two snaps 56, preferably female, of the neck roll 50 are coupled to the two snaps 46A, preferably male, of the padded portion 46 and removed as necessary. The elongated roll 52 includes a substantially elongated cutout portion 58 for accepting the vertical shaft 38 and still allowing the neck roll 50 to comfortably support the neck.

The use of the present invention would be fairly straightforward as illustrated in FIG. 1. The present invention would first be adjusted to fit the wheelchair 34 by sliding the sleeves 26 outwardly from the horizontal segment 12 so that the sleeves 26 snugly engage the handles 32 of the wheelchair 34. The height of the headrest portion 36 is next adjusted to comfortably suit the occupant of the wheelchair 34.

In conclusion, herein is presented a removable adjustable head rest for wheelchairs for providing users of wheelchairs with much needed neck support. The invention is illustrated by example in the drawings figures, and throughout the written description. It should be understood that numerous variations are possible, while adhering to the inventive concept. Such variations are contemplated as being a part of the present invention.

What is claimed is:

1. A removable headrest, for use with a wheelchair having a pair of handles extending substantially parallel and spaced apart by a handle width, comprising:

a hollow cylindrical main portion, having a generally T-shaped configuration including a horizontal segment and a vertical segment, the horizontal segment has opposed open ends, the vertical segment has an open upper end;

a pair of handle sleeves, each handle sleeve having an inner end and an outer end, the inner end of each handle sleeve received within one of the opposed open ends of the horizontal segment, the outer ends of each sleeve having a tubular collar, the tubular collars are each adapted to receive one of the wheelchair handles therethrough, the handle sleeves are adjustably positionable within the horizontal segment to adjust a distance between the tubular collars to accommodate the handle width of the wheelchair;

a headrest portion comprising two integrally coupled adjustable side portions, which allow the headrest to be bent inwardly;

a vertical shaft having an upper end and a lower end, the lower end is received the open upper end of the vertical segment;

a padded portion having two snaps wherein the headrest portion is secured to the upper end of the vertical shaft; and a neck roll comprising a substantially elongated roll having an attachment strip and two snaps disposed on said attachment strip, wherein the two snaps of the neck roll are coupled to the two snaps of the padded portion, wherein the elongated roll includes a substantially elongated cutout portion means for accepting the ver tical shaft and still allowing the neck roll to comfortably support the neck.

2. The removable headrest as recited in claim 1, wherein the horizontal segment has a plurality of horizontally aligned apertures extending therethrough inwardly of the opposed open ends, wherein each of the handle sleeves have a spring-biased male detent element extending outwardly therefrom, and wherein each male detent element selectively aligns with one of the plurality of horizontally aligned apertures to fix its associated sleeve with respect to the horizontal segment.

3. The removable headrest as recited in claim 2, wherein the vertical segment has a plurality of vertically aligned apertures downwardly from the upper end, wherein the vertical shaft has a male detent element extending outwardly therefrom, and wherein the male detent element selectively aligns with one of the plurality of vertically aligned apertures to fix the vertical shaft with respect to the vertical segment.

* * * * *